US011263857B1

(12) United States Patent
Miller

(10) Patent No.: US 11,263,857 B1
(45) Date of Patent: Mar. 1, 2022

(54) RECONFIGURATION OF A MEDIA RECYCLER

(71) Applicant: NCR Corporation, Atlanta, GA (US)

(72) Inventor: Alexander Pearson Miller, Dundee (GB)

(73) Assignee: NCR Corporation, Atlanta, GA (US)

( * ) Notice: Subject to any disclaimer, the term of this patent is extended or adjusted under 35 U.S.C. 154(b) by 0 days.

(21) Appl. No.: 17/002,155

(22) Filed: Aug. 25, 2020

(51) Int. Cl.

| | |
|---|---|
| ***G07D 11/12*** | (2019.01) |
| ***G07D 11/30*** | (2019.01) |
| ***G07D 11/25*** | (2019.01) |
| ***G07D 11/60*** | (2019.01) |
| ***G07D 11/23*** | (2019.01) |

(52) U.S. Cl.
CPC ..... *G07D 11/30* (2019.01); *G07D 11/12* (2019.01); *G07D 11/23* (2019.01); *G07D 11/25* (2019.01); *G07D 11/60* (2019.01); *G07D 2211/00* (2013.01)

(58) Field of Classification Search
CPC ..... G07F 19/20; G07F 19/202; G07F 19/203; G07F 19/205; G07F 19/206; G07F 19/209; G07D 11/10–13; G07D 11/16; G07D 11/18; G07D 11/30–36; G07D 2211/00
See application file for complete search history.

(56) References Cited

U.S. PATENT DOCUMENTS

| | | | | |
|---|---|---|---|---|
| 4,511,794 | A * | 4/1985 | Imamichi | G07F 19/20 235/379 |
| 6,726,095 | B2 * | 4/2004 | Tamura | G07D 11/24 235/379 |
| 9,672,681 | B2 * | 6/2017 | Du | G07D 11/26 |
| 2002/0107800 | A1 * | 8/2002 | Kadowaki | G06Q 20/1085 705/43 |
| 2004/0011622 | A1 * | 1/2004 | Omori | G07D 11/24 194/230 |

* cited by examiner

*Primary Examiner* — Thien M Le
*Assistant Examiner* — April A Taylor
(74) *Attorney, Agent, or Firm* — Schwegman, Lundberg & Woessner

(57) ABSTRACT

Disclosed herein are systems and methods for re-configuring a recycling unit of a self-service terminal that includes a plurality of cassettes. The systems and methods can include receiving an indication that a first cassette of the plurality of cassettes has reached a storage capacity. A second cassette can be selected from the plurality of cassettes after the first cassette has reached the storage capacity. The second cassette can initially be one of a plurality of recycling cassettes. A parameter associated with the second cassette can be changed to indicate the second cassette is no longer a recycling cassette.

20 Claims, 3 Drawing Sheets

RECONFIGURATION OF A MEDIA RECYCLER

FIELD OF THE DISCLOSURE

The present subject matter relates to media recyclers. More particularly, the present disclosure relates to reconfiguring media recyclers in self-service terminals.

BACKGROUND

Today's self-service terminals are able to both accept and dispense media objects. This provides convenience to users as it can allow them to make both deposits and withdrawals without having to visit a bank or interact with a teller. The ability to provide both deposit and withdrawal services via a single machine provides costs savings to the banks by allowing for a single machine to perform multiple services instead of single machines dedicated to single services.

SUMMARY

Disclosed herein are systems and methods for re-configuring a recycling unit of a self-service terminal that includes a plurality of cassettes. The systems and methods can include receiving an indication that a first cassette of the plurality of cassettes has reached a storage capacity. A second cassette can be selected from the plurality of cassettes after the first cassette has reached the storage capacity. The second cassette can initially be one of a plurality of recycling cassettes. A parameter associated with the second cassette can be changed to indicate the second cassette is no longer a recycling cassette.

BRIEF DESCRIPTION OF THE FIGURES

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

Corresponding reference characters indicate corresponding parts throughout the several views. The exemplifications set out herein illustrate exemplary embodiments of the invention, and such exemplifications are not to be construed as limiting the scope of the invention any manner.

DETAILED DESCRIPTION

Figure 1:
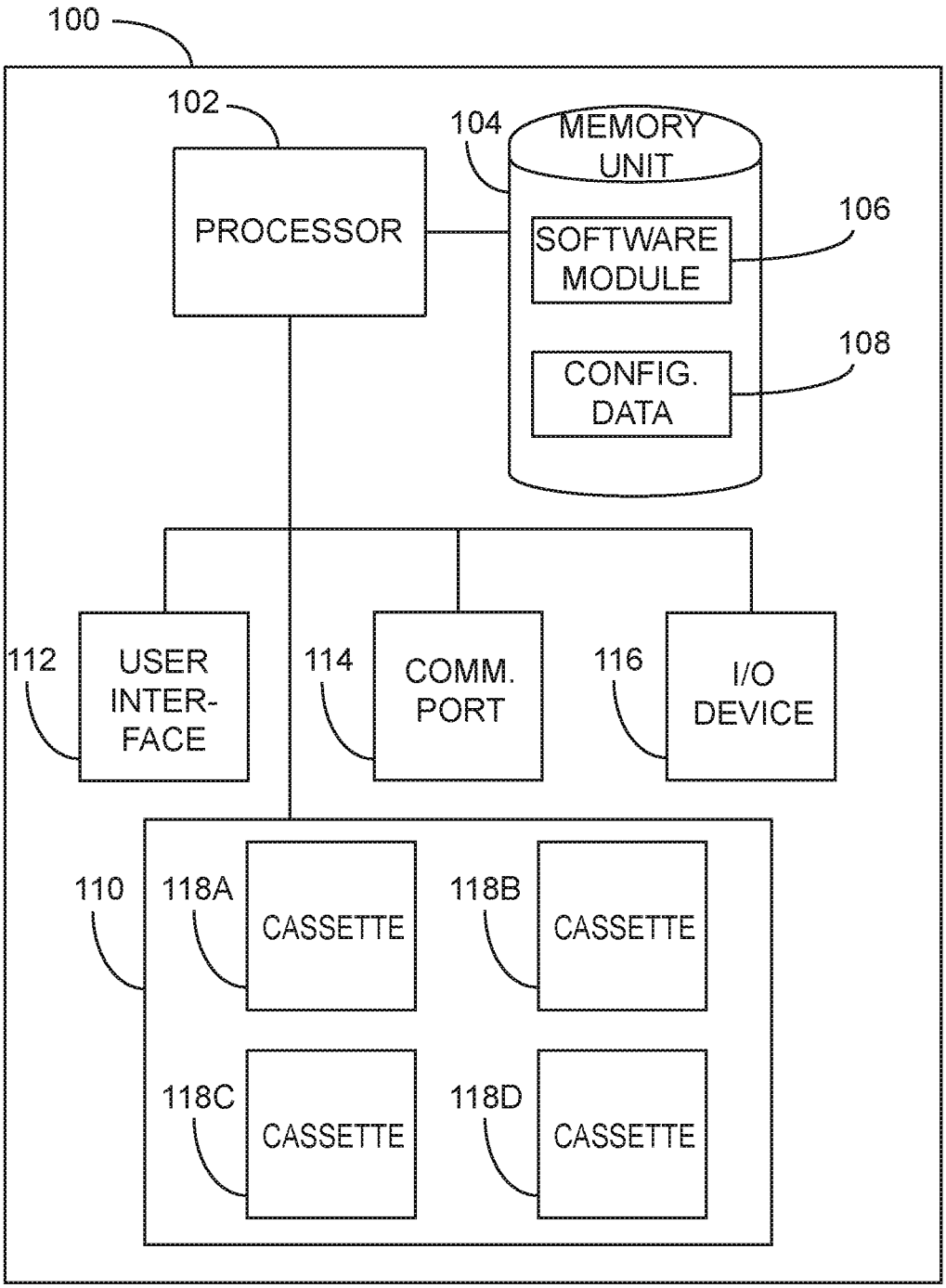
FIG. 1 shows an example schematic of a self-service terminal consistent with examples of this disclosure.

During operation, the various cassettes of media recyclers can accept and dispense media. For example, a first customer may utilize a self-service terminal (SST), such as an automated teller machine (ATM), to deposit banknotes. Upon receiving the banknotes, the ATM may deposit the banknotes into one or more cassettes of a media recycler of the ATM. For instance, the first customer may deposit a $10 bill and two $20 bills. The $10 bill may be deposited into a first cassette that stores only $10 bills and the two $20 bills may be stored in one or more cassettes that each store only $20 bills. A second customer may utilize the ATM to withdraw a single $20 bill and the ATM may dispense the $20 from any one of the one or more cassettes that stores $20 bills.

One factor that assist in defining how long a media recycler can remain in service is often the capacity of the deposit cassette(s), e.g., the various cassettes. If one or more of these cassettes become full then the self-service terminal may either go out of service or has to stop accepting a subset of notes, causing customer inconvenience. Stated another way, the SST now has a reduced functionality and the customer is aware of this reduced functionality due to the SST being completely out of service or not being able to handle a particular transaction the customer expects.

As disclosed herein, the SST, or the media recycler of the SST can be reconfigured on the fly to accommodate situations where one or more of the various recycler cassettes becomes full. By reconfiguring the SST or media recycler of the SST the customer is able to use the SST as expected even though the SST may have a reduced functionality. Stated another way, the customer perceives the SST to be fully functional while the actual functionality of the SST may be diminished. Consistent with embodiments disclosed herein, the customer is never aware of the reduced functionality because the systems and methods disclosed herein allow for an automatic and seamless reconfiguration of other recycling cassette to store media, such as banknotes.

SSTs may have multiple types of cassettes. One type of cassette is a recycling cassette that is able to both accept and dispense media in other words, a recycling cassette can recycle media objects. A recycling cassette can be configured to have a genuine fit for banknotes of a single denomination and notes categorized as being suitable for dispensing to customers. For example, Euro banknotes have different sizes and recycling cassettes can be configured for specific denominations such as 5, 10, 20, and 50 Euro banknotes. Stated another way, the recycling cassettes can be adjusted to store the notes they are intended to contain neatly so that the notes can be dispensed without causing jams and other errors.

Another type of cassette is a deposit only cassette, which can only receive media and store media objects. A deposit only cassette, sometimes referred to as deposit cassette, cannot be dispense media objects. Deposit cassettes can be used to contain subsets of the notes accepted, such as for specific denominations or categories of notes (e.g., notes which are suspected of being counterfeit). Deposit cassettes can also be configured to accept any banknotes.

Another type of cassette is a dispense/withdrawal only cassette. As the name implies, dispense/withdrawal only cassettes can only dispense media objects. An example of a dispense/withdrawal cassette can include a cassette loaded with a particular denomination banknote that is placed into an SST so that customers can make withdrawals.

Using the systems and methods disclosed herein, the cassettes of an SST can be managed to allow the SST to remain in service for longer time periods. One of the advantages of recyclers is to decrease a bank's costs by allowing notes deposited by one customer to be dispensed to another customer, therefore saving on replenishment costs compared to two separate devices. Costs are also reduced by having one device that can support both transaction types, thus saving on hardware costs. Therefore, in deposit transactions, the priority could be to deposit items into the recycling cassettes rather than deposit cassette so that the deposited notes can be given to other customers. Any notes which cannot be assigned to recycling cassettes could be assigned to deposit cassettes.

When the deposit cassettes become full, the only way to get them back in service is via a service call where maintenance personnel empty or replace the cassette. With conventional SSTs, when the deposit cassette is full, the problem is what to do with notes which cannot be recycled and therefore would normally go into the deposit cassette. The notes could be refused, which would at best inconvenience customers. Returning notes may not be possible as legislation may be in place, such as ECB's rules, that may prohibit suspected counterfeit items to be returned to the customer. Therefore, in practice, deposit capacity being unavailable means the SST has to go out of service.

As disclosed herein, adding more deposit capacity can increase up-time. However, current SSTs and media handling units have a fixed number of cassettes, therefore an initial configuration that increases the deposit capacity means decreasing recycling capacity, which would decrease up-time. The more recycling cassettes there are, the fewer deposit only cassettes there can be and vice-versa. In addition, banks may have requirements to recycle four or more denominations (for example RJR 5, 10, 20, 50), so the hardware options are limited.

The solutions disclosed herein provide dynamic reconfiguration of cassettes to utilize spare capacity in recycling cassettes, sometimes referred to as rollover cassettes, when the standard deposit capacity becomes unusable. As the use of cassettes change, the rollover cassette can automatically change configurations to match the new environment.

Considerations that can be account for when a cassette is selected to become a rollover cassette can include, but are not limited to, note compatibility (e.g., physical dimensions), compatibility for applications, reserving space for additional items, and configurability Recycling cassettes can be fitted with internal guides to contain the notes in as small a space as possible, ensuring that the notes do not move about during transit. Compatibility is important because if notes are not properly stacked on top of each other, the likelihood of jams can increase.

As the notes are contained tightly within the cassette, only notes which fit the space constraints should be deposited in the cassette. Normally this is not an issue for recycling cassettes as they are single denomination and hence all are the same or very similar size. However, if such a cassette is to be used for deposit only and other denominations are deposited, this could cause a problem if larger notes enter the cassette. For example, trying to deposit a 50 Euro banknote in a cassette configured for 5 Euro banknotes could cause problems.

To address compatibility issues, the SST can detect which cassettes are compatible with which notes and only assign notes appropriate to the cassette as disclosed herein. As an example, the SST can be programmed with an original configuration of the recycling cassette, for example a 50 Euro note, and hence only allow notes which are the size of an FUR 50 or smaller to be deposited in the recycling cassette as it changes to become a rollover cassette.

As disclosed herein, the rollover cassette can be assigned and then a parameter associated with the cassette can be changed. The change in parameter can simulate that the existing cassette unit has been removed and a different cassette with a new configuration has been inserted. In other words, the SST thinks the cassettes have been physically swapped, but in reality, the cassettes have not been removed and the SST simply sees what it thinks are new cassettes to use. Stated another way, the SST configuration changes to mimic physically swapping the cassettes, while not actually swapping the cassettes.

When a rollover cassette is actually removed during servicing, the configuration of the SST can be reset so that the newly inserted cassette can act as a recycling cassette. Therefore, the replenishment operation would not result in a perceived change in functionality by a user. The rollover cassette could be taken away to be emptied in exactly the same way as a regular deposit cassette, replacing it with another pre-filled recycling cassette would mean the denomination can now be recycled again. Rollover cassettes remain as such until they are removed, and the configuration can remain persistent.

As disclosed herein, space constraints on the SST may mean that only a subset of banknotes can be deposited in this way into cassettes. In addition, it may not be desirable to mix other categories of notes that would normally go into the regular deposit cassettes with good notes. For example, the deposit cassette may be configured to accept suspect and unfit notes and these notes should not be added to a rollover cassette. Examples of suspect notes include notes suspected of being a counterfeit because the notes failed one or more inspection tests performed by a bill validator. Examples of unfit notes include notes that have damage or other wear that they are no longer fit for circulation such as notes that are torn, frayed, ripped, or have portions of the notes that are missing. The definition of suspect or unfit notes can also be provided by a governing body, such as the U.S. Federal Reserve or the European Central Bank, see https://www.ecb.europa.eu/pub/pdf/other/recyclingeurobanknotes2005en.pdf. Suspect and unfit notes can be sorted separately and stored in deposit only cassettes since suspect and unfit notes are not intended to be recycled.

The solutions disclosed herein, allow for space to be reserved in the deposit cassette so that notes which cannot be accepted into the rollover cassette can still be deposited into the original deposit cassette.

Turning now to the figures, FIG. 1 shows an example schematic of a self-service terminal 100 consistent with this disclosure. Self-service terminal 100 may include a processor 102 and a memory 104. Memory 104 may include a software module 106 and configuration data 108. When executed by processor 102, software module 106 may cause processor 102 to perform actions for reconfiguring a media handler 110, including, for example, one or more stages included in a method 300 described below with respect to FIG. 3.

Self-service terminal 100 may include a user interface 112. User interface 112 may include a keypad, a display (touchscreen or otherwise), etc. In addition, user interface 112 may include audio equipment such as speakers, a microphone, a headphone jack, etc. that may be used to allow a user to interface with self-service terminal 100. While FIG. 1 shows a single user interface, self-service terminal 100 may include a plurality of user interfaces.

Self-service terminal 100 may also include a communications port 114. While FIG. 1 shows a single communications port, self-service terminal 100 can include a plurality of communications ports. Communications port 114 may allow self-service terminal 100 to communicate with various information sources, such as, but not limited to, remote computing devices such as servers, bank teller computers, maintenance systems (static or portable), etc. As disclosed herein, communications port 114 may be wired or wireless. Non-limiting examples of communications port 114 include, Ethernet cards (wireless or wired), BLUETOOTH® transmitters and receivers, near-field communications modules, serial port interfaces, WI-FI® adapters, etc.

Self-service terminal 100 may also include an input/output (I/O) device 116. While FIG. 1 shows a single I/O device, self-service terminal 100 may include a plurality of I/O devices. I/O device 116 may allow self-service terminal 100 to receive and output information, either direct to other equipment or via communications port 114 and/or user interface 112. Non-limiting examples of I/O device 116 include, limit switches, sensors (optical or otherwise), a camera (still or video), a printer, a scanner, biometric readers, etc. For example, I/O device 116 may include switches and/or sensors used to monitor various components of self-service terminal 100, such as media lander 110.

Media handler 110 can include any number of cassettes 118 (labeled individually as cassette 118A, 118B, 118C, and 118D). While FIG. 1 shows four cassettes, media handler 110 can include any number of cassettes greater than 1. During an initial setup of self-service terminal 100, self-service terminal 100 and configuration data 108, can be configured such that one of cassettes 118, such as cassette 118D, is a deposit cassette. Cassettes 118A, 118B, and 118C can be configured as recycling cassettes. Specifically, cassette 118C can be configured to recycle 50 Euro notes and cassettes 118A and 118B can be configured to recycle 20 Euro notes.

During operation, deposit cassette 118D can fill up as deposits are made. Upon filling up, processor 102, while executing instructions stored in memory unit 104, such as software module 106, can select any one of cassettes 118A, 118B, or 118C to be a rollover cassette. For example, cassette 118C can be selected as a rollover cassette and a parameter associated with cassette 118C stored in memory unit 104 can be changed so that processor 102 sees cassette 118C as a deposit only cassette instead of a recycling cassette.

Figure 2A:
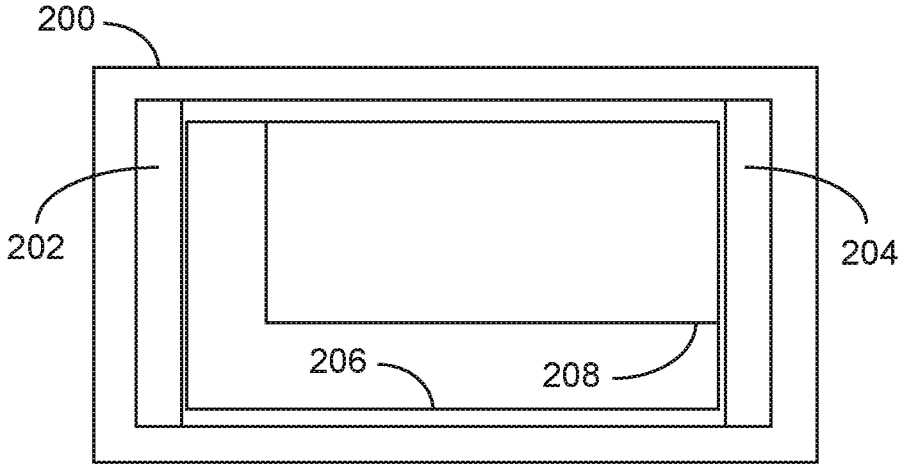
FIGS. 2A and 2B each shows an example schematic of cassette consistent with examples of this disclosure.

As disclosed herein, the selection of cassette 118C can be based on the denomination of notes currently located in cassette 118C and/or the physical dimensions of notes stored in cassette 118C. For example, as shown in FIG. 2A, a cassette 200, such as any one of cassettes 118 (e.g., cassette 118C), can include guides 202 and 204. Guides 202 and 204 can be spaced to facilitate recycling of a 50 Euro note 206. Thus, when cassette 1180 is selected as a rollover cassette, a 5 Euro note 208 can be stored without issue. Other guides can be included. For example, both vertical and horizontal guides can be provided to correctly position media objects. For instance, a vertical guide can constrain the media objects in a vertical direction and the horizontal guides can constrain the media objects in the horizontal direction.

Figure 2B:
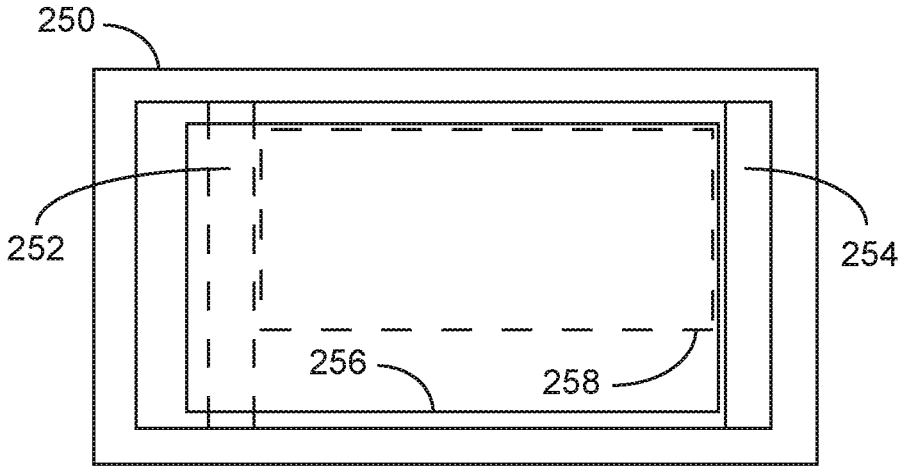

FIG. 2B shows a cassette 250, such as any one of cassettes 118, that can include guides 252 and 254. Guides 252 and 254 can be spaced to facilitate storage of 5 Euro notes 258. As shown in FIG. 2B, a larger note, such as a 50 Euro note 256, may not physically fit into cassette 250 given its larger physical dimensions.

For U.S. currency, which has the same physical dimensions for each denomination, physical dimensions may not be a factor in selecting a rollover cassette. Instead, denomination alone may be used. For example, cassette 118D may initially be a deposit cassette while cassettes 118A, 118B, and 118C are initially configured as recycling cassettes for $10, $20, and $20 notes. Since each of the U.S. notes has the same physical dimensions, when a rollover cassette is needed, any one of cassettes 118A, 118B, and 118C can be selected. The determination of which cassette to select can be based on capacity remaining and/or the denominations of cassettes 118A, 118B, and 118C. For example, if cassette 118B is 25% empty and cassette 118C has an ample supply of $20 notes, then cassette 118B can be selected as the rollover cassette and assigned as a deposit only cassette.

Figure 3:
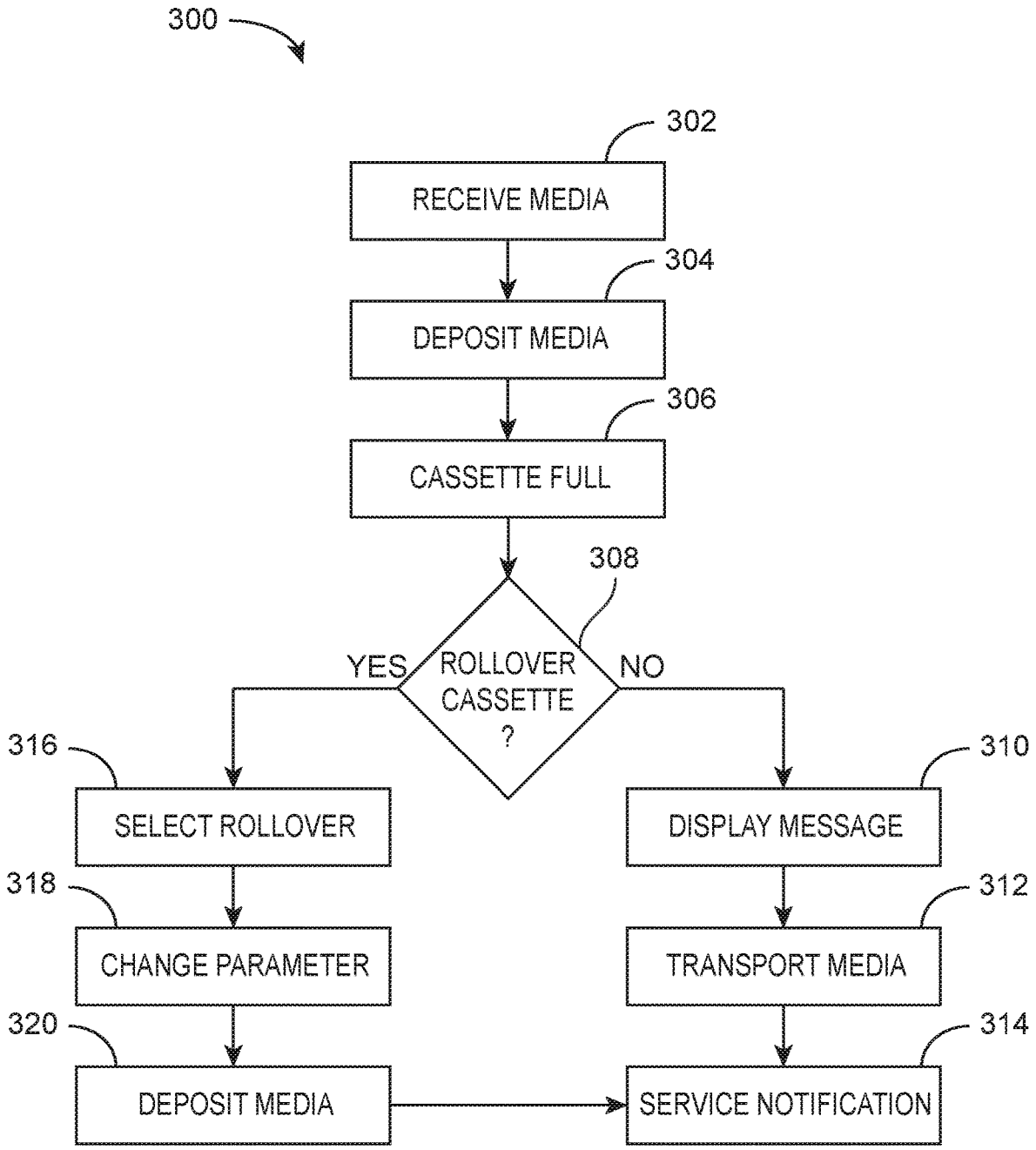
FIG. 3 shows method consistent with examples of this disclosure.

As disclosed herein, configuration data 108 may include various data and parameters that define a type (e.g., flags that define a type as recycle, rollover, or deposit), denomination, physical dimensions of notes, etc. stored in cassettes 118 as well as operating parameters of cassettes 118. During operation, processor 102 can retrieve and manipulate configuration data 108 from memory unit 104. For example, processor 102 can access the parameter that defines what type of cassette cassette 118C is and change the parameter from recycle to deposit as disclosed herein, FIG. 3 shows an example method 300 consistent with this disclosure. Method 300 may begin at stage 302 where media may be received at a self-service terminal, such as self-service terminal 100. For example, during a transaction a user may deposit media, such as banknotes into a media handler of the self-service terminal.

As the self-service terminal receives the media, one or more of the media objects can be deposited into one or more cassettes (304). For example, the self-service terminal may have a plurality of cassettes and one or more of the received media objects can be deposited into one or more of the cassettes. For instance, one of the media objects may be transported and deposited into a first cassette that is a storage only cassette and other media objects can be deposited into one or more cassettes, or a subset of the plurality of cassettes, which may be recycling cassettes.

During transactions and/or after transactions, the self-service terminal can monitor a state of each of the cassettes. For example, the cassettes may include optical and/or mechanical switches and/or sensors that detect how full the cassettes are (306). For instance, optical sensors may determine when the cassettes have a predetermined amount of media in them and then transmit an indication that the cassette has reached a given storage capacity. The predetermined amount may be a fraction of the total storage capacity of the cassettes. For instance, upon a storage cassette reaching between about 80% and about 95% of a total storage capacity, the processor of the self-service terminal may receive a signal from the switches/sensors (i.e., I/O devices). The processor can convert the signals to a capacity reading using equations or lookup tables.

After receiving the signal from the cassette and determining a cassette is nearly full, the self-service terminal can determine if a rollover cassette is available (308). If a rollover cassette is not available, then the self-service terminal may display a service advisory or other message (310). For example, the self-service terminal may display a service advisory that indicates the self-service terminal is only operative for deposit of certain types or that the self-service terminal is only operative to dispense media from the remaining cassettes. For instance, the self-service terminal may display a service message indicating it is only available to allow customers to make withdrawals in multiples of $20. After displaying the service advisory the customer may make either a withdrawal or deposit depending on the state of the various cassettes and media can be transmitted accordingly (312). Also, once a determination is made that a rollover cassette is not available, the self-service terminal may transmit a service notification to a remote computer to alert service personnel that maintenance is needed (314).

Upon the storage cassette reaching its predetermined storage capacity (306) and a determination is made that a rollover cassette is available (308), the self-service terminal may select a rollover cassette (316). For example, at stage 316, the self-service terminal may determine a capacity of each of the plurality of recycling cassettes as well as retrieve configuration data, such as configuration data 108, to determine the physical dimensions and/or denomination of the notes in each of the plurality of recycling cassettes. The self-service terminal may also determine a capacity remaining for each of the plurality of recycling cassettes.

Using the various information for the recycling cassettes, the self-service terminal may select one of the recycling cassettes to be the rollover cassette. For example, using the various data, the self-service terminal may determine that a second of the plurality of recycling cassettes contains 50 Euro notes and is about 85% empty and that there is a third cassette that has 50 Euro notes and is only 15% empty. Given that there is an alternate cassette that can dispense 50 Euro notes and a cassette that can hold 5, 10, and 20 Euro notes (because they are physically smaller than the 50 Euro note) is almost empty, the self-service terminal can select the second cassette to be the rollover cassette.

After selecting a cassette to be the rollover cassette, the self-service terminal can change a parameter associated with the selected cassette to indicate that the selected cassette is no longer a recycling cassette (318). For example, a flag or other data stored in the memory of the self-service terminal can be changed. For instance, the flag may have three states. A first state can indicate that the cassette is a deposit only cassette. A second state can indicate that the cassette is a recycling cassette. The third state can indicate that the cassette is available as a rollover cassette. The flags may be updated after and/or during a transaction so the availability of a cassette as a rollover cassette can change during a transaction as the state of the flag is updated.

The same applies to the changing of a cassette from a recycling cassette to a deposit only cassette. During the transaction as media is being accepted a cassette may become full and thus no longer able to accept media. As a result, the stage of the flag associated with the cassette may change during a transaction and alternate cassettes used to complete the transaction. By changing the state of each cassette during and/or after transactions, the customer using the self-service terminal may not perceive that there is a potential problem with the self-service terminal because. As a result, the customer may perceive that the self-service terminal is operating at full functionality and media can be deposit (320) as the user expects. Once the parameter has been changed to indicate a recycling cassette is now a deposit only cassette, a service notification can be transmitted to a remote computer or other service personnel (314).

While the various stages of method 300 have been described in a particular order, one skilled in the art, in view of this disclosure, will understand that various stages can be reordered and/or omitted without departing from the scope of this disclosure. For example, stage 310 were a service advisory/message is displayed can be omitted along with stage 312 and a service notification can be transmitted (314) without displaying any messages. In addition, method 300 can operate in a continuous loop performed as each media object is received or can simply operate at the end of a transaction to determine if a deposit cassette is full. In another example, at the beginning of a transaction, a customer may provide information about the transaction such as a number of notes and the denomination of each note. Using this information, the self-service terminal may perform method 300 to determine if the state of a cassette needs to be changed before or during the acceptance of the notes.

EXAMPLES

The following, non-limiting examples, detail certain aspects of the present subject matter to solve the challenges and provide the benefits discussed herein, among others.

Example 1 is a method for re-configuring a recycling unit of a self-service terminal comprising a plurality of cassettes, the method comprising: receiving, at a computing device, an indication that a first cassette of the plurality of cassettes has reached a storage capacity; selecting, by the computing device, a second cassette from the plurality of cassettes, the second cassette initially being one of a plurality of recycling cassettes; changing, by the computing device, a parameter associated with the second cassette to indicate the second cassette is no longer a recycling cassette.

In Example 2, the subject matter of Example 1 optionally includes wherein selecting the second cassette from the plurality of cassettes includes selecting the second cassette based on a denomination of banknotes stored in the second cassette.

In Example 3, the subject matter of any one or more of Examples 1-2 optionally include wherein selecting the second cassette from the plurality of cassettes includes selecting the second cassette based on a physical dimension of banknotes stored in the second cassette.

In Example 4, the subject matter of any one or more of Examples 1-3 optionally include wherein changing the parameter associated with the second cassette includes changing the parameter to indicate the second cassette is a storage only cassette.

In Example 5, the subject matter of Example 4 optionally includes displaying, on a display of the self-service terminal, a service advisory indicating the self-service terminal is only operative for deposits; and transporting a media object to the second cassette.

In Example 6, the subject matter of any one or more of Examples 1-5 optionally include wherein changing the parameter associated with the second cassette includes changing the parameter to indicate the second cassette is a dispense only cassette.

In Example 7, the subject matter of Example 6 optionally includes displaying, on a display of the self-service terminal, a service advisory indicating the self-service terminal is only operative for withdrawals; and dispensing a media object from the second cassette.

In Example 8, the subject matter of any one or more of Examples 1-7 optionally include transmitting a service notification to a remote computer.

Example 9 is a method for re-configuring a recycling unit of a self-service terminal comprising a plurality of cassettes, the method comprising: receiving, at a computing device, an indication that a first cassette of the plurality of cassettes has reached a storage capacity; selecting, by the computing device, a second cassette from the plurality of cassettes, the second cassette having an original configuration including a parameter stored in a memory of the computing device, the parameter indicating the second cassette is one of a plurality of recycling cassettes; changing, in the memory of the computing device, the parameter to indicate the second cassette is not a recycling cassette; and transmitting, by the computing device, a service notification to a remote computer.

In Example 10, the subject matter of Example 9 optionally includes wherein selecting the second cassette from the plurality of cassettes includes selecting the second cassette based on a denomination of banknotes stored in the second cassette.

In Example 11, the subject matter of any one or more of Examples 9-10 optionally include wherein selecting the second cassette from the plurality of cassettes includes selecting the second cassette based on a physical dimension of banknotes stored in the second cassette.

In Example 12, the subject matter of any one or more of Examples 9-11 optionally include wherein changing the parameter includes changing the parameter to indicate the second cassette is a storage only cassette.

In Example 13, the subject matter of Example 12 optionally includes displaying, on a display of the self-service terminal, a service advisory indicating the self-service terminal is only operative for deposits; and transporting a media object to the second cassette.

In Example 14, the subject matter of any one or more of Examples 9-13 optionally include wherein changing the parameter includes changing the parameter to indicate the second cassette is a dispense only cassette.

In Example 15, the subject matter of Example 14 optionally includes displaying, on a display of the self-service terminal, a service advisory indicating the self-service terminal is only operative for withdrawals; and dispensing a media object from the second cassette.

Example 16 is a self-service terminal comprising: a first cassette having a first parameter defining a storage capacity; a second cassette having a second parameter indicating the second cassette is initially operative to store and dispense media objects; a processor; and a memory storing instructions that, when executed by the processor, cause the processor to perform actions comprising: receiving an indication that the first cassette has reached the storage capacity, selecting the second cassette from a plurality of cassettes, changing, in the memory, the second parameter to indicate the second cassette is operative to only store additional media objects, and transmitting a service notification to a remote computer.

In Example 17, the subject matter of Example 16 optionally includes wherein selecting the second cassette from the plurality of cassettes includes selecting the second cassette based on a denomination of banknotes stored in the second cassette.

In Example 18, the subject matter of any one or more of Examples 16-17 optionally include wherein selecting the second cassette from the plurality of cassettes includes selecting the second cassette based on a physical dimension of banknotes stored in the second cassette.

In Example 19, the subject matter of any one or more of Examples 16-18 optionally include a display, wherein the actions further comprise displaying, on the display, a service advisory indicating the self-service terminal is only operative for withdrawals.

In Example 20, the subject matter of any one or more of Examples 16-19 optionally include a display, wherein the actions further comprise displaying, on the display, a service advisory indicating the self-service terminal is only operative for deposits.

In Example 21, the apparatuses or method of any one or any combination of Examples 1-20 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A method for re-configuring a recycling unit of a self-service terminal comprising a plurality of cassettes, the method comprising:

designating, by a computing device during an initial setup of the self-service terminal, a first cassette of the plurality of cassettes as a deposit cassette;

receiving, at the computing device, an indication that the first cassette of the plurality of cassettes has reached a storage capacity;

selecting, by the computing device, a second cassette from the plurality of cassettes, the second cassette initially being one of a plurality of recycling cassettes, wherein selecting the second cassette includes selecting the second cassette based on a maximum size of media object acceptable by the second cassette being larger than a maximum size of media object acceptable by at least one of the plurality of recycling cassettes, the maximum size of media object acceptable by the second cassette defined by a set of guides installed in the second cassette; and changing, by the computing device, a parameter associated with the second cassette to indicate the second cassette is no longer a recycling cassette.

2. The method of claim 1, wherein selecting the second cassette from the plurality of cassettes includes selecting the second cassette based on a denomination of banknotes stored in the second cassette.

3. The method of claim 1, wherein selecting the second cassette from the plurality of cassettes includes selecting the second cassette based on a physical dimension of banknotes stored in the second cassette.

4. The method of claim 1, wherein changing the parameter associated with the second cassette includes changing the parameter to indicate the second cassette is a storage only cassette.

5. The method of claim 4, further comprising:

displaying, on a display of the self-service terminal, a service advisory indicating the self-service terminal is only operative for deposits; and transporting a media object to the second cassette.

6. The method of claim 1, wherein changing the parameter associated with the second cassette includes changing the parameter to indicate the second cassette is a dispense only cassette.

7. The method of claim 6, further comprising:

displaying, on a display of the self-service terminal, a service advisory indicating the self-service terminal is only operative for withdrawals; and dispensing a media object from the second cassette.

8. The method of claim 1, further comprising transmitting a service notification to a remote computer.

9. A method for re-configuring a recycling unit of a self-service terminal comprising a plurality of cassettes, the method comprising:

designating, by a computing device during an initial setup of the self-service terminal, a first cassette of a plurality of cassettes as a deposit cassette;

designating, by the computing device during the initial setup of the self-service terminal, a remainder of the plurality of cassettes as recycling cassettes;

receiving, at the computing device, an indication that the first cassette of the plurality of cassettes has reached a storage capacity;

selecting, by the computing device, a second cassette from the plurality of cassettes, the second cassette having an original configuration including a parameter stored in a memory of the computing device during the initial setup of the self-service terminal, the parameter indicating the second cassette is one of a plurality of recycling cassettes, wherein selecting the second cassette includes selecting the second cassette based on a maximum size of media object acceptable by the second cassette being larger than a maximum size of media object acceptable by at least one of the plurality of recycling cassettes, the maximum size of media object acceptable by the second cassette defined by a set of guides installed in the second cassette;

changing, in the memory of the computing device, the parameter to indicate the second cassette is not a recycling cassette; and transmitting, by the computing device, a service notification to a remote computer.

10. The method of claim 9, wherein selecting the second cassette from the plurality of cassettes includes selecting the second cassette based on a denomination of banknotes stored in the second cassette.

11. The method of claim 9, wherein selecting the second cassette from the plurality of cassettes includes selecting the second cassette based on a physical dimension of banknotes stored in the second cassette.

12. The method of claim 9, wherein changing the parameter includes changing the parameter to indicate the second cassette is a storage only cassette.

13. The method of claim 12, further comprising:

displaying, on a display of the self-service terminal, a service advisory indicating the self-service terminal is only operative for deposits; and transporting a media object to the second cassette.

14. The method of claim 9, wherein changing the parameter includes changing the parameter to indicate the second cassette is a dispense only cassette.

15. The method of claim 14, further comprising:

displaying, on a display of the self-service terminal, a service advisory indicating the self-service terminal is only operative for withdrawals; and dispensing a media object from the second cassette.

16. A self-service terminal comprising:

a first cassette having a first parameter defining a storage capacity;

a second cassette having a second parameter indicating the second cassette is initially operative to store and dispense media objects, the second cassette including a first set of guides defining a maximum size of media object acceptable by the second cassette;

a processor; and a memory storing instructions that, when executed by the processor, cause the processor to perform actions comprising:

designating during an initial setup of the self-service terminal that the first cassette is a first deposit cassette, receiving an indication that the first cassette has reached the storage capacity, selecting the second cassette from a plurality of cassettes based on the maximum size of media object acceptable by the second cassette being larger than a maximum size of media object acceptable by at least one of the plurality of cassettes, changing, in the memory, the second parameter to indicate the second cassette is a second deposit cassette operative to only store additional media objects, and transmitting a service notification to a remote computer.

17. The self-service terminal of claim 16, wherein selecting the second cassette from the plurality of cassettes includes selecting the second cassette based on a denomination of banknotes stored in the second cassette.

18. The self-service terminal of claim 16, wherein selecting the second cassette from the plurality of cassettes includes selecting the second cassette based on a physical dimension of banknotes stored in the second cassette.

19. The self-service terminal of claim 16, further comprising a display, wherein the actions further comprise displaying, on the display, a service advisory indicating the self-service terminal is only operative for withdrawals.

20. The self-service terminal of claim 16, further comprising a display, wherein the actions further comprise displaying, on the display, a service advisory indicating the self-service terminal is only operative for deposits.

* * * * *